US005460542A

United States Patent [19]

Castellani et al.

[11] Patent Number: 5,460,542

[45] Date of Patent: Oct. 24, 1995

[54] MULTIPLE-OUTLET RECEPTACLE

[75] Inventors: Norman Castellani, Park Ridge, N.J.; Harcharan S. Bagga, Bronx, N.Y.

[73] Assignee: Raceway Components, Inc., Paterson, N.J.

[21] Appl. No.: 345,121

[22] Filed: Nov. 28, 1994

Related U.S. Application Data

[63] Continuation of Ser. No. 147,752, Nov. 4, 1993, abandoned, which is a continuation of Ser. No. 813,145, Dec. 23, 1991, abandoned.

[51] Int. Cl.[6] ..... H01R 25/00

[52] U.S. Cl. ..... 439/535; 439/650

[58] Field of Search ..... 439/106, 107, 439/652, 654, 536, 538, 650

[56] References Cited

U.S. PATENT DOCUMENTS

| | | | |
|---|---|---|---|
| 3,975,075 | 8/1976 | Mason | 439/107 |
| 4,386,813 | 6/1983 | Griffin | 439/107 |
| 4,583,799 | 4/1986 | Wiley | 439/106 |
| 4,978,318 | 12/1990 | Wiley et al. | 439/536 |
| 5,124,876 | 6/1992 | Miseneik et al. | 439/106 |
| 5,135,411 | 8/1992 | Wiley et al. | 439/536 |

FOREIGN PATENT DOCUMENTS

| | | | |
|---|---|---|---|
| 1105939 | 5/1961 | Germany | 439/650 |
| 836564 | 6/1960 | United Kingdom | 439/107 |

*Primary Examiner*—Gary F. Paumen
*Attorney, Agent, or Firm*—Drucker & Sommers

[57] ABSTRACT

A receptacle, adapted to enable activated wires to be connected thereto and therethrough for activation thereof, which includes a plurality of bus bars adapted to connect and isolate current inputs to enable the receptacle to accommodate multiple power plugs for multiple electronic devices. The receptacle further includes plug blade retention contacts, adapted to firmly grip, retain, and provide positive contacts and connection between plug blades and receptacle outlets. It further includes grounding contacts and wires adapted to effectively ground electronic equipment.

44 Claims, 2 Drawing Sheets

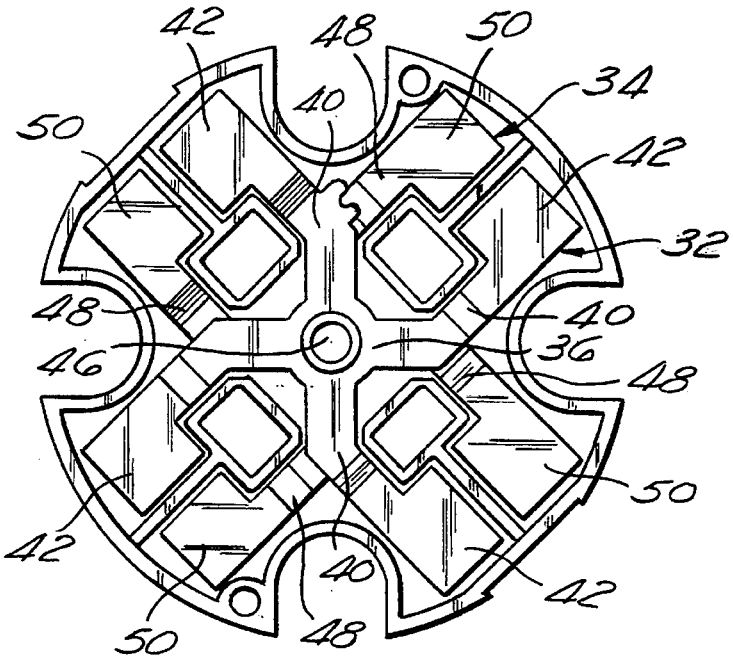
Fig. 2
Fig. 3
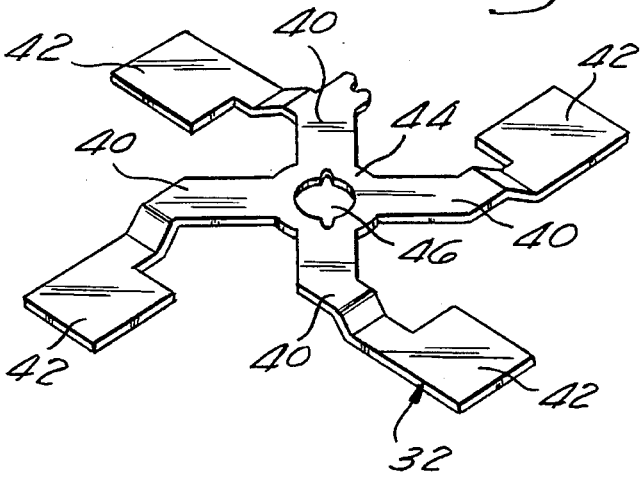
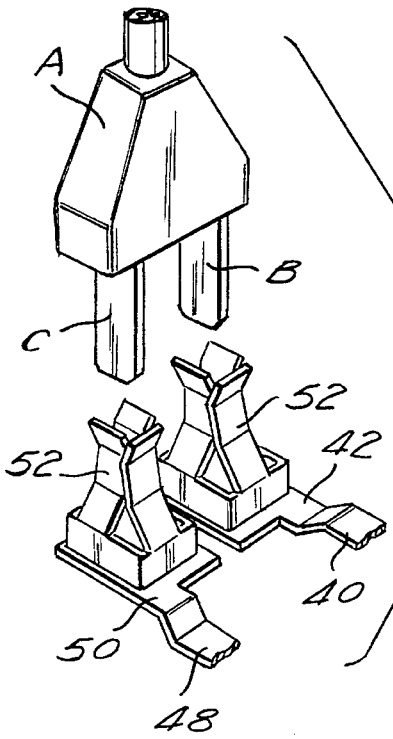
Fig. 4

MULTIPLE-OUTLET RECEPTACLE

This application is a continuation of application Ser. No. 08/147,752, filed Nov. 4, 1993, now abandoned, which is a continuation of application Ser. No. 07/813,145, filed Dec. 23, 1991, now abandoned.

BACKGROUND OF THE INVENTION

The invention relates generally to electrical receptacles. It relates specifically to a multiple-outlet receptacle.

The configuration of known receptacles limited the power capacity thereof, while the demand for higher power capacity has increased substantially due to the increasing quantity and sophistication of electronic devices. This has generated increased demand for higher power capacity.

It is desirable for fittings to safely and effectively accommodate multiple power connections.

Further, it is desirable for such receptacles to safely and effectively accommodate increased copper in increased numbers of power lines.

It is further desirable for such receptacles to provide positive contact and connection between power wires and receptacle outlets.

Further, it is desirable for such receptacles to safely and effectively accommodate, hold fast, and firmly set an increased number of plugs, and to provide increased plug blade contact and support, as required for compliance with electrical safety codes, and for certification in plug retention tests at independent commercial testing laboratories.

Such codes and tests require that the plug cap be held securely, since increased vibration of the plug due to insecure retention causes arcing, forming carbon deposits, which render the plug unusable and causes short circuits.

Further, it is desirable for such receptacles to reduce electrical noise which generates electromagnetic interference with electronic equipment.

Still further, it is desirable for such receptacles to be capable of providing separate power circuits for separate electronic devices, to reduce electrical interference therebetween.

SUMMARY OF THE INVENTION

The receptacle of the invention is adapted to overcome the above problems, as well as others, associated with known receptacles.

The receptacle of the invention is adapted to provide increased power capacity, to meet the demand therefore resulting from the increasing quantity and sophistication of electronic devices, to provide safe and effective accommodation of multiple power connections, to reduce electrical noise which generates electromagnetic interference with electronic equipment, and to be capable of being configured for electronic equipment, to comply with the requirements of electrical safety codes, and to comply with the requirements of electrical safety testing at an independent commercial testing laboratory.

It includes a multiple outlet receptacle adapted to accommodate multiple power plugs for activation of multiple electronic devices, including a plurality of elements adapted to be configured and mounted so as to connect multiple current inputs of the same type, and isolate multiple current inputs of the different type, in the receptacle outlets. The multiple outlet receptacle provides increased power capacity to meet the demand therefore resulting from the increasing quantity and sophistication of electronic devices, provides safe and effective accommodations of multiple power connections, and reduces electrical noise which generates electromagnetic interference with electronic equipment.

The receptacle is further adapted to provide positive contact and connection between power wires and receptacle outlets, and to accommodate, securely hold, and firmly seat an increased number of power plugs in the receptacle outlets, and to prevent arcing which would form carbon deposits, rendering the outlet unusable, and causing short circuits.

It includes plug blade and prong retention contacts for engaging and securely retaining plug blades upon insertion thereof in corresponding outlet slots. The retention contacts firmly grip and retain, and provide positive contact and connection between plug blades and receptacle outlets, and accommodate, securely hold, and firmly seat the increased number of power plugs in the receptacle outlets, to prevent arcing and the formation of carbon deposit, to prevent rendering the outlets unsafe and unusable, and to prevent short circuits.

The receptacle is further adapted to be capable of providing separation of power circuits, for a plurality of clean electrical circuits without electrical cross-noise from electromagnetic interference with electronic equipment.

The receptacle is still further adapted to provide separation of power circuits, for a plurality of clean electrical circuits without electrical cross-noise from electromagnetic interference with electronic equipment.

BRIEF DESCRIPTION OF THE DRAWINGS

FIG. 2 is a top plan view of the bus bars and mounting housing in the receptacle of the invention;

FIG. 3 is a perspective view of a bus bar in the receptacle of the invention; and FIG. 4 is a partly-broken perspective view of plug and receptacle contacts, and bus bar legs and contact plates, in the receptacle of the invention.

DESCRIPTION OF THE PREFERRED EMBODIMENT

Figure 1:
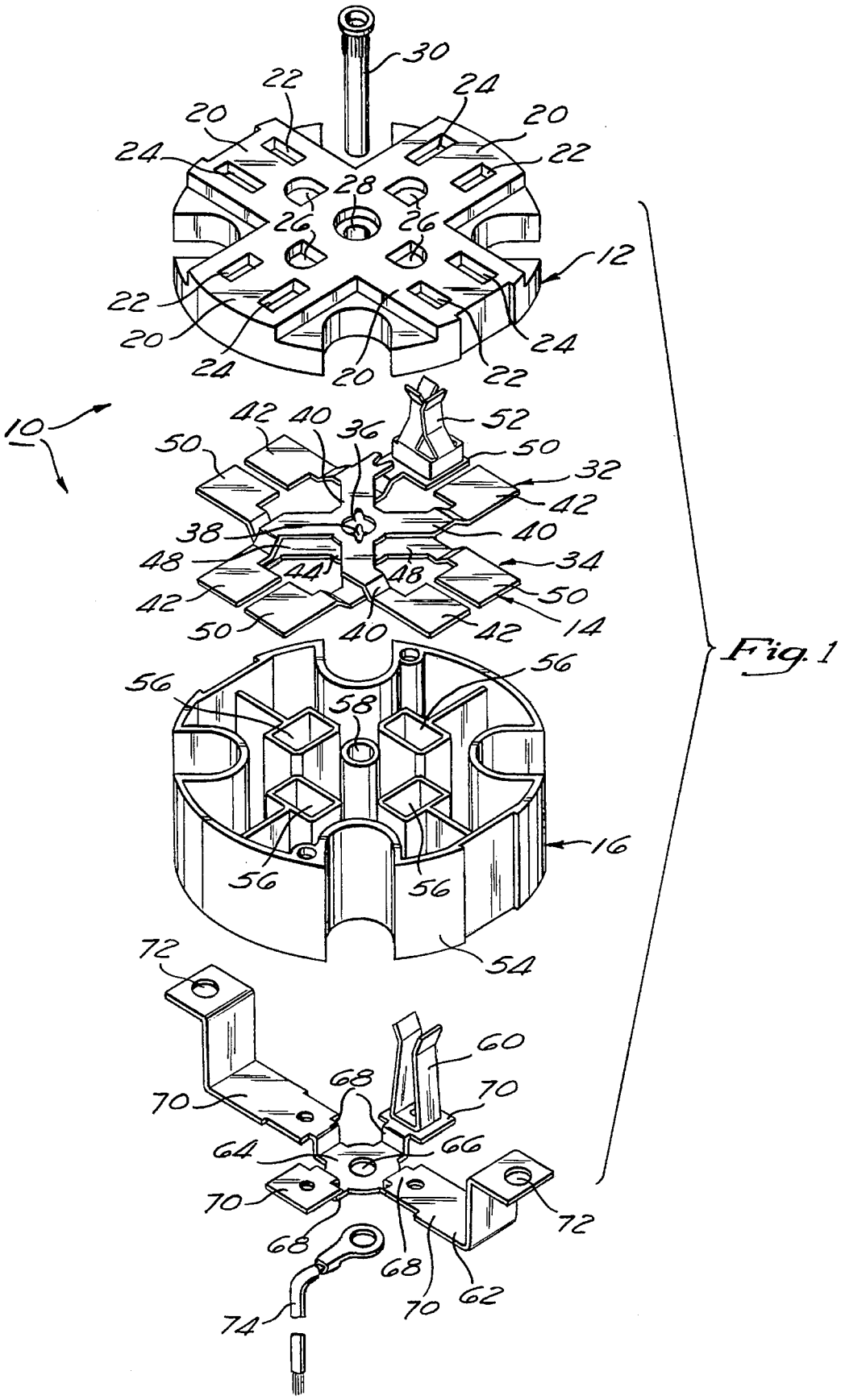
FIG. 1 is an exploded perspective view of the receptacle of the invention.

The receptacle 10 of the invention, in the preferred embodiment as shown in FIGS. 1–4 and described below, is adapted to enable activation of multiple electrical devices.

Receptacle 10 is adapted to accommodate substantial power capacity, for enabling a plurality of devices to be plugged thereinto.

Activated power wires for activating receptacle 10 may originate from outside sources. The power wires may be pre-wired to run to receptacle 10.

Receptacle 10, as shown in FIGS. 1–4, is adapted to enable a line conductor wire, a neutral conductor wire, and a ground wire, (not shown), to be connected thereto for activation thereof. The line conductor wire, neutral conductor wire, and ground wire may be pre-wired in receptacle 10.

Receptacle 10 is further adapted to accommodate substantial power capacity for enabling a plurality of devices to be plugged thereinto, and to accept a plurality of plugs, as plugs A in FIG. 4, which plugs A each include a line conductor blade B, a neutral conductor blade C, and a ground prong (not shown).

Receptacle 10 includes a cover 12, first elements 14, adapted to interconnect and isolate line and neutral connections, a mounting housing 16, and second elements 18, adapted to connect and isolate ground connections.

Receptacle cover 12 includes a plurality of outlets 20, including a plurality of line conductor slots 22, each adapted to accept a plug line conductor blade B, a plurality of neutral conductor slots 24, each adapted to accept a plug neutral conductor blade C and to be paired with a line conductor slot 22, and a plurality of ground slots 26, each adapted to accept a plug ground prong (not shown). Receptacle cover 12 further includes a central opening 28, adapted to receive threaded sleeve 30 which is adapted to receive an assembly screw (not shown).

Receptacle 10, in the preferred embodiment thereof, includes four line conductor slots 22, four neutral conductor slots 24, and four ground slots 26, forming a quadruple outlet receptacle. Ground slots 26 in receptacle cover 12 are spaced proximate to, and substantially equal distances from and concentrically about, central opening 28.

Pairs of line conductor slots 22 and neutral conductor slots 24 are spaced substantially equal distances from, and generally concentrically about, central opening 28, and further from central opening 28 than ground slots 26.

First elements 14 of receptacle 10 include a line bus bar 32 adapted to interconnect the plurality of line conductor slots 22 and to isolate the plurality of neutral conductor slots 24, and a neutral bus bar 34, adapted to interconnect the plurality of neutral conductor slots 24 and to isolate the plurality of line conductor slots 22.

Line bus bar 32 and neutral bus bar 34 are adapted to be inverted relative to each other and positioned in the supported position in receptacle 10.

The shapes of line bus bar 32 and neutral bus bar 34 are substantially the same, and are further such that line bus bar 32 and neutral bus bar 34 are adapted to be isolated from each other upon inversion and complementary positioning thereof in receptacle 10.

Line bus bar 32 and neutral bus bar 34 are generally x-shaped.

Line bus bar 32 includes a central portion 36 having a central opening 38 adapted to receive threaded sleeve 30, a plurality of bent legs 40 extending generally radially outwardly from central portion 36, and a plurality of contact plates 42 at the outer ends of legs 40.

Neutral bus bar 34 includes a central portion 44 having a central opening 46, a plurality of legs 48, extending generally radially outwardly from central portion 44, and a plurality of contact plates 50 at the outer ends of legs 48.

Line conductor wires are adapted to be connected to line bus bar 32 at contact plates 42. Neutral conductor wires are adapted to be connected to neutral bus bar 34 at contact plates 50.

Legs 48 of neutral bus bar 34 are adapted, upon positioning thereof in receptacle 10, to tunnel under legs 40 of line bus bar 32.

Receptacle 10 further includes a plurality of contacts 52, adapted to retain plug line conductor blades B and plug neutral conductor blades C in position plugged into receptacle line conductor slots 22 and receptacle neutral conductor slots 24.

Contacts 52 are adapted to be mounted on line bus bar contact plates 42 and neutral bus bar contact plates 50. Each contact 52 is generally inverted T-shaped in cross-section.

Mounting housing 16 of receptacle 10 includes support frame 54, a plurality of ground contact slots 56, and a central opening 58, adapted to receive threaded sleeve 30.

Second elements 18 of receptacle 10 include a plurality of contacts 60, adapted to retain the plug ground prongs in position plugged into receptacle ground slots 26, and to extend through ground contact slots 56 of mounting housing 16, a mounting strap 62, including a central portion 64 having a central opening 66, a plurality of bent legs 68 extending generally radially outwardly from central portion 64, a plurality of contact plates 70 at the ends of legs 68 to which contacts 60 are adapted to be mounted, and mounting screw holes 72 adapted to receive mounting screws (not shown), and a grounding wire 74, adapted to be connected to mounting strap 62.

Ground wires are adapted to be connected to mounting straps 62 at contact plates 70.

Ground wire 74 is adapted to be connected to mounting strap 62 at central portion 64, and to terminate directly at the electronic equipment conductor terminal (not shown), or isolated grounding of the electronic equipment.

Receptacle 10 may be configured to provide separate power circuits for separate circuits for electronic equipment.

To install receptacle 10, the power wires, originating from outside sources, may be connected to a pre-wired line conductor wire, neutral conductor wire, and ground wire, for activation of receptacle 10.

In use, multiple plugs A from electronic devices may be plugged into receptacle 10, with the ground prongs connected closest to the central portion of receptacle outlets 20, and the line blades B and neutral blades C connected at the peripheral portions of receptacle outlets 20, to accommodate multiple plugs A in multiple receptacle outlets 20.

Receptacle 10, including line bus bar 32 and neutral bus bar 72 which are adapted to connect multiple current inputs of the same type, and to isolate multiple current inputs of the different type, in power plugs A, is adapted to accommodate multiple power plugs A for activation of multiple electronic devices to meet the demand therefor resulting from the increasing quantity and sophistication of electronic devices for office workstations, to provide safe and effective accommodation of multiple power connections, to reduce electrical noises which generates electromagnetic interference with electronic equipment, and to be capable of being configured to provide separate power circuits for separate circuits for electronic equipment.

Receptacle 10, including plug blade retention contacts 60, is further adapted to engage and securely retain plug line conductor blades B and plug neutral conductor blades C upon insertion of plugs A in receptacle cover line conductor slots 22 and neutral conductor slots 24, to firmly grip, retain, and provide positive contact and connection between plug blades and receptacle outlets. It prevents arcing and formation of carbon deposits, to prevent rendering the outlets unsafe and unusable, and to prevent short circuits.

Receptacle 10, including ground contacts 60 and grounding wire 74, is further adapted to be isolated from the receptacle mounting position, and to provide an isolating ground which terminates directly at the equipment conductor terminal, for safe and effective grounding of electronic equipment.

A preferred embodiment of the invention has been set forth above, for the purpose of explaining the invention. However, it is to be understood that variations in such embodiment may be within the scope and spirit of the invention as set forth in the claims.

We claim:

1. A receptacle, for enabling line and neutral conductor wires to be connected thereto for activation thereof, in which the power capacity of the receptacle is substantially greater than the power capacity of a duplex receptacle so as to enable a plurality of devices to be plugged thereinto, and for accepting a plurality of standard plugs, which plugs each include a line conductor blade and neutral conductor blade, which receptacle includes:

(a) a central portion;

(b) a plurality of outlets, which extend in a ring relative to the central portion of the receptacle, each of which extends symmetrically in relation to a corresponding radius extending from the central portion, said outlets including a plurality of line conductor slots, each for accepting a standard plug line conductor blade, and a plurality of neutral conductor slots, each for accepting a standard plug neutral conductor blade and paired with a corresponding said line conductor slots, and (c) a plurality of line conductor contacts associated with the plurality of line conductor slots;

(d) a plurality of neutral conductor contacts associated with the plurality of neutral conductor slots;

(e) means for interconnecting the plurality of line conductor contacts and isolating the plurality of line conductor contacts from the plurality of neutral conductor contacts;

(f) means for interconnecting the plurality of neutral conductor contacts and isolating the plurality of neutral conductor contacts from the plurality of line conductor contacts;

(g) means for connecting a line conductor wire to the line conductor contact interconnecting means; and (h) means for connecting the neutral conductor wire to the neutral conductor contact interconnecting means;

(i) in which the power capacity of the plurality of line conductor slots and the plurality of neutral conductor slots is substantially greater than the power capacity of the duplex receptacle.

2. A receptacle as in claim 1, in which each line conductor slot extends substantially parallel to a corresponding radius extending from the central portion of the receptacle, and each neutral conductor slot extends substantially parallel to a corresponding radius extending from the central portion of the receptacle and substantially parallel to a corresponding line conductor slot.

3. A receptacle as in claim 1, in which the line and neutral conductor slots are spaced generally concentrically about the central portion.

4. A receptacle as in claim 1, in which the ground slots are spaced generally concentrically about the central portion.

5. A receptacle as in claim 1, in which corresponding pairs of the plurality of line and neutral conductor slots are spaced substantially equal distances from the central portion.

6. a receptacle as in claim 1, in which the plurality of line conductor slots, neutral conductor slot, and ground slots are oriented in a substantially parallel configuration spaced circumferentially about the central portion of the receptacle.

7. A receptacle as in claim 1, in which the plurality of ground slots are spaced substantially equal distances from the central portion.

8. A receptacle as in claim 1, in which the plurality of ground slots are spaced proximate the central portion.

9. A receptacle as in claim 1, in which the plurality of line conductor slots and neutral conductor slots are spaced substantially equal distances from the central portion, the plurality of ground slots are spaced substantially equal distances from the central portion, and the plurality of ground slots are spaced closer to the central portion than the plurality of line conductor slots and neutral conductor slots.

10. A receptacle as in claim 1, in which the line conductor contacts interconnecting means extend in a first plane, the neutral conductor contacts interconnecting means extend in a second plane, and the first plane in which the line conductor contacts interconnecting means extend is different from the second plane in which the neutral conductor contacts interconnecting means extend.

11. A receptacle as in claim 1, in which the line conductor contact interconnecting means comprise a line bus bar.

12. A receptacle as in claim 1, in which the neutral conductor contact interconnecting means comprise a neutral bus bar.

13. A receptacle as in claim 1, in which the plurality of line conductor slots comprise four line conductor slots.

14. A receptacle as in claim 1, in which the plurality of neutral conductor slots comprise four neutral conductor slots.

15. A receptacle as in claim 1, further comprising means for retaining the plug line conductor and neutral conductor blades in position plugged into receptacle line conductor and neutral conductor slots, in which the blades retaining means comprise the plurality of line conductor contact and neutral conductor contact, adapted to be mounted on the line conductor contact interconnecting means and the neutral conductor contact interconnecting means, and adapted to retain the plug line and neutral conductor blades.

16. A receptacle as in claim 10, in which the neutral conductor interconnecting means comprise a bus bar, in which the shape and size of the line bus bar and the neutral bus bar are substantially the same.

17. A receptacle as in claim 10, in which the neutral bus bar includes leg portions for tunneling under the line bus bar upon positioning thereof in the receptacle.

18. A receptacle as in claim 10, in which the line bus bar and neutral bus bar are generally x-shaped.

19. A receptacle as in claim 10, in which the line conductor contact interconnecting means comprise a line bus bar, the neutral conductor contact interconnecting means comprise a neutral bus bar, and the shape and size of the line and neutral bus bars is such that the line and neutral bus bars are adapted to be isolated from each other upon inversion and complementary positioning thereof in the receptacle.

20. A receptacle as in claim 10, in which the line conductor contact interconnecting means comprise a line bus bar, the neutral conductor contact interconnecting means comprise a neutral bus bar, and the line and neutral bus bars are adapted to be inverted relative to each other and positioned in the supporting position in the receptacle.

21. A receptacle, for enabling line and neutral conductor wires to be connected thereto for activation thereof, in which the power capacity of the receptacle is substantially greater than the power capacity of a duplex receptacle so as to enable a plurality of devices to be plugged thereinto, and for accepting a plurality of standard plugs, which plugs each include a line conductor blade and neutral conductor blade, which receptacle includes:

(a) a central portion;

(b) a plurality of outlets, which include a plurality of line conductor slots, each for accepting a standard plug line conductor blade, and a plurality of neutral conductor slots, each for accepting a standard plug neutral conductor blade and to be paired with a corresponding line conductor slot;

(c) a plurality of line conductor contacts associated with the plurality of line conductor slots;

(d) a plurality of neutral conductor contacts associated with the plurality of neutral conductor slots;

(e) means for interconnecting the plurality of line conductor contacts and isolating the plurality of line conductor contacts from the plurality of neutral conductor contacts, said interconnecting means extending in a first plane;

(f) means for interconnecting the plurality of neutral conductor contacts and isolating the plurality of neutral conductor contacts from the plurality of line conductor contacts, said interconnecting means extending in a second plane;

(g) means for connecting a line conductor wire to the line conductor contact interconnecting means; and (h) means for connecting a neutral conductor wire to the neutral conductor contact interconnecting means;

(i) in which the power capacity of the plurality of line conductor slots and the plurality of neutral conductor slots is substantially greater than the power capacity of the duplex receptacle; and (j) in which the first plane in which the line conductor contacts interconnecting means extends is different from the second plane in which the neutral conductor contacts interconnecting means extends.

22. A receptacle as in claim 21, in which the neutral conductor contact interconnecting means comprise a bus bar, in which the line conductor contact interconnecting means comprise a line bus bar, and the shape and size of the line bus bar and the neutral bus bar are substantially the same.

23. A receptacle as in claim 21, in which the line conductor contact interconnecting means comprise a line bus bar, the neutral conductor contact interconnecting means comprise a neutral bus bar, and the neutral bus bar includes leg portions for tunneling under the line bus bar upon positioning thereof in the receptacle.

24. A receptacle as in claim 21, in which the line conductor contact interconnecting means comprise a line bus bar, the neutral conductor contact interconnecting means comprise a neutral bus bar, and the line bus bar and neutral bus bar are each generally x-shaped.

25. A receptacle as in claim 21, in which the line conductor contact interconnecting means comprise a line bus bar, the neutral conductor contacts interconnecting means comprise a neutral bus bar, and the shape and size of the line and neutral bus bars is such that the line and neutral bus bars are adapted to be isolated from each other upon inversion and complementary positioning thereof in the receptacle.

26. A receptacle as in claim 21, in which the line and neutral bus bars are adapted to be inverted relative to each other and positioned in a supported position in the receptacle.

27. A receptacle as in claim 21, in which the receptacle further includes a central portion, and the plurality of line conductor slots are the plurality of neutral conductor slots comprise a plurality of outlets which extend in a concentric ring relative to the central portion of the receptacle, each of which extends symmetrically in relation to a corresponding radius extending from the central portion.

28. A receptacle as in claim 21, in which each line conductor slot extends substantially parallel to a corresponding radius extending from the central portion of the receptacle, and each neutral conductor slot extends substantially parallel to a corresponding radius extending from the central portion of the receptacle and substantially parallel to a corresponding line conductor slot.

29. A receptacle as in claim 27, in which the line and neutral conductor slots are spaced generally concentrically about the central portion.

30. A receptacle as in claim 27, in which the ground slots are spaced generally concentrically about the central portion.

31. A receptacle as in claim 27, in which corresponding pairs of the plurality of line and neutral conductor slots are spaced substantially equal distances from the central portion.

32. A receptacle as in claim 27, in which the plurality of line conductor slots, neutral conductor slot, and ground slots are oriented in a substantially parallel configuration spaced circumferentially about the central portion of the receptacle.

33. A receptacle as in claim 27, in which the plurality of ground slots are spaced substantially equal distances from the central portion.

34. A receptacle as in claim 27, in which the plurality of ground slots are spaced proximate the central portion.

35. A receptacle as in claim 27, in which the plurality of line conductor slots and neutral conductor slots are spaced substantially equal distances from the central portion, the plurality of ground slots are spaced substantially equal distances from the central portion, and the plurality of ground slots are spaced closer to the central portion than the plurality of line conductor slots and neutral conductor slots.

36. A receptacle as in claim 27, in which the line conductor contact interconnecting means comprise a line bus bar.

37. A receptacle as in claim 27, in which the neutral conductor contact interconnecting means comprise a neutral bus bar.

38. A receptacle as in claim 27, in which the plurality of line conductor slots comprise four line conductor slots.

39. A receptacle, adapted to enable line and neutral conductor wires to be connected thereto for activation thereof, in which the power capacity of the receptacle is substantially greater than the power capacity of a duplex receptacle so as to enable a plurality of devices to be plugged thereinto, and adapted to accept a plurality of standard plugs, which plugs each include a line conductor blade and neutral conductor blade, which receptacle includes:

(a) a plurality of line conductor slots, each adapted to accept a standard plug line conductor blade;

(b) a plurality of neutral conductor slots, each extending substantially parallel to a corresponding line conductor slot, and each adapted to accept a standard plug neutral conductor blade and paired with a said line conductor slot;

(c) a plurality of line conductor contacts associated with the plurality of line conductor slots;

(d) a plurality of neutral conductor contacts associated with the plurality of neutral conductor slots;

(e) means for interconnecting the plurality of line conductor contacts and isolating the plurality of line conductor contacts from the plurality of neutral conductor contacts;

(f) means for interconnecting the plurality of neutral conductor contacts and isolating the plurality of neutral conductor contacts from the plurality of line conductor contacts;

(g) means for connecting a line conductor wire to the line conductor contact interconnecting means; and (h) means for connecting the neutral conductor wire to the neutral conductor contact interconnecting means;

(i) in which the power capacity of the plurality of line conductor slots and the plurality of neutral conductor slots is substantially greater than the power capacity of the duplex receptacle;

(j) in which the line conductor contact interconnecting means comprise a bus bar; and (k) in which the neutral conductor contact interconnecting means comprise a bus bar, in which the shape and size of the line bus bar and the neutral bus bar are substantially the same, and in which the number of the plurality of line conductor contacts, neutral conductor contacts, and ground contacts is greater than two each.

40. A receptacle, adapted to enable line and neutral conductor wires to be connected thereto for activation thereof, in which the power capacity of the receptacle is substantially greater than the power capacity of a duplex receptacle so as to enable a plurality of devices to be plugged thereinto, and adapted to accept a plurality of standard plugs, which plugs each include a line conductor blade and neutral conductor blade, which receptacle includes:

(a) a plurality of line conductor slots, each adapted to accept a standard plug line conductor blade;

(b) a plurality of neutral conductor slots, each extending substantially parallel to a corresponding line conductor slot, and each adapted to accept a standard plug neutral conductor blade and to be paired with a line conductor slot;

(c) a plurality of line conductor contacts associated with the plurality of line conductor slots;

(d) a plurality of neutral conductor contacts associated with the plurality of neutral conductor slots;

(e) means for interconnecting the plurality of line conductor contacts and isolating the plurality of line conductor contacts from the plurality of neutral conductor contacts;

(f) means for interconnecting the plurality of neutral conductor contacts and isolating the plurality of neutral conductor contacts from the plurality of line conductor contacts;

(g) means for connecting the line conductor wire to the line conductor contact interconnecting means; and (h) means for connecting the neutral conductor wire to the neutral conductor contact interconnecting means;

(i) in which the power capacity of the plurality of line conductor slots and the plurality of neutral conductor slots is substantially greater than the power capacity of the duplex receptacle;

(j) in which the line conductor contact interconnecting means comprise a bus bar; and (k) in which the neutral conductor contact interconnecting means comprise a bus bar, and in which the neutral bus bar includes leg portions adapted, upon positioning thereof in the receptacle, to tunnel under the line bus bar.

41. A receptacle, adapted to enable line and neutral conductor wires to be connected thereto for activation thereof, in which the power capacity of the receptacle is substantially greater than the power capacity of a duplex receptacle so as to enable a plurality of devices to be plugged thereinto, and adapted to accept a plurality of standard plugs, which plugs each include a line conductor blade and neutral conductor blade, which receptacle includes:

(a) a plurality of line conductor slots, each adapted to accept a standard plug line conductor blade;

(b) a plurality of neutral conductor slots, each extending substantially parallel to a corresponding line conductor slot, and each adapted to accept a standard plug neutral conductor blade and to be paired with a line conductor slot;

(c) a plurality of line conductor contacts associated with the plurality of line conductor slots;

(d) a plurality of neutral conductor contacts associated with the plurality of neutral conductor slots;

(e) means for interconnecting the plurality of line conductor contacts and isolating the plurality of line conductor contacts from the plurality of neutral conductor contacts;

(f) means for interconnecting the plurality of neutral conductor contacts and isolating the plurality of neutral conductor contacts from the plurality of line conductor contacts;

(g) means for connecting the line conductor wire to the line conductor contact interconnecting means; and (h) means for connecting the neutral conductor wire to the neutral conductor contact interconnecting means;

(i) in which the power capacity of the plurality of line conductor slots and the plurality of neutral conductor slots is substantially greater than the power capacity of the duplex receptacle;

(j) further adapted to enable a ground wire to be connected thereto, in which the plugs each further include a ground prong, and the receptacle further includes a plurality of ground slots, each adapted to accept a plug ground prong, a plurality of ground contacts associated with the plurality of ground slots, means for interconnecting the plurality of ground contacts, and means for connecting the ground wire to the ground contact interconnecting means;

(k) in which the receptacle includes a central portion, the plurality of line conductor slots and neutral conductor slots are spaced substantially equal distances from the central portion, the plurality of ground slots are spaced substantially equal distances from the central portion, and the plurality of ground slots are spaced closer to the central portion than the plurality of line conductor slots and neutral conductor slots; and (l) in which the line and neutral conductor slots are spaced generally concentrically about the central portion.

42. A receptacle, adapted to enable line and neutral conductor wires to be connected thereto for activation thereof, in which the power capacity of the receptacle is substantially greater than the power capacity of a duplex receptacle so as to enable a plurality of devices to be plugged thereinto, and adapted to accept a plurality of standard plugs, which plugs each include a line conductor blade and neutral conductor blade, which receptacle includes:

(a) a plurality of line conductor slots, each adapted to accept a standard plug line conductor blade;

(b) a plurality of neutral conductor slots, each extending substantially parallel to a corresponding line conductor slot, and each adapted to accept a standard plug neutral conductor blade and to be paired with a line conductor slot;

(c) a plurality of line conductor contacts associated with the plurality of line conductor slots;

(d) a plurality of neutral conductor contacts associated with the plurality of neutral conductor slots;

(e) means for interconnecting the plurality of line conductor contacts and isolating the plurality of line conductor contacts from the plurality of neutral conductor contacts;

(f) means for interconnecting the plurality of neutral conductor contacts from the plurality of line neutral conductor contacts from the plurality of line conductor contacts;

(g) means for connecting the line conductor wire to the line conductor contact interconnecting means; and (h) means for connecting the neutral conductor wire to the neutral conductor contact interconnecting means;

(i) in which the power capacity of the plurality of line conductor slots and the plurality of neutral conductor slots is substantially greater than the power capacity of the duplex receptacle;

(j) in which the line conductor contact interconnecting means comprise a bus bar;

(k) in which the neutral conductor contact interconnecting means comprise a bus bar, in which the shape and size of the line bus bar and the neutral bus bar are substantially the same, and in which the number of the plurality of line conductor contacts, neutral conductor contacts, and ground contacts is greater than two each; and (l) in which the line bus bar and neutral bus bar are each generally x-shaped.

43. A receptacle, adapted to enable line and neutral conductor wires to be connected thereto for activation thereof, in which the power capacity of the receptacle is substantially greater than the power capacity of a duplex receptacle so as to enable a plurality of devices to be plugged thereinto, and adapted to accept a plurality of standard plugs, which plugs each include a line conductor blade and neutral conductor blade, which receptacle includes:

(a) a plurality of line conductor slots, each adapted to accept a standard plug line conductor blade;

(b) a plurality of neutral conductor slots, each extending substantially parallel to a corresponding line conductor slot, and each adapted to accept a standard plug neutral conductor blade and to be paired with a line conductor slot;

(c) a plurality of line conductor contacts associated with the plurality of line conductor slots;

(d) a plurality of neutral conductor contacts associated with the plurality of neutral conductor slots;

(e) means for interconnecting the plurality of line conductor contacts and isolating the plurality of line conductor contacts from the plurality of neutral conductor contacts;

(f) means for interconnecting the plurality of neutral conductor contacts and isolating the plurality of neutral conductor contacts from the plurality of line conductor contacts;

(g) means for connecting the line conductor wire to the line conductor contact interconnecting means; and (h) means for connecting the neutral conductor wire to the neutral conductor contact interconnecting means;

(i) in which the power capacity of the plurality of line conductor slots and the plurality of neutral conductor slots is substantially greater than the power capacity of the duplex receptacle;

(j) in which the line conductor contact interconnecting means comprise a bus bar;

(k) in which the neutral conductor contact interconnecting means comprise a bus bar, in which the shape and size of the line bus bar and the neutral bus bar are substantially the same and in which the number of the plurality of line conductor contacts, neutral conductor contacts, and ground contacts is greater than two each; and (l) in which the line conductor contact interconnecting means comprise a line bus bar, the neutral conductor contact interconnecting means comprise a neutral bus bar, and the shape and size of the line and neutral bus bars is such that the line and neutral bus bars are adapted to be isolated from each other upon inversion and complementary positioning thereof in the receptacle.

44. A receptacle, adapted to enable line and neutral conductor wires to be connected thereto for activation thereof, in which the power capacity of the receptacle is substantially greater than the power capacity of a duplex receptacle so as to enable a plurality of devices to be plugged thereinto, and adapted to accept a plurality of standard plugs, which plugs each include a line conductor blade and neutral conductor blade, which receptacle includes:

(a) a plurality of line conductor slots, each adapted to accept a standard plug line conductor blade;

(b) a plurality of neutral conductor slots, each extending substantially parallel to a corresponding line conductor slot, and each adapted to accept a standard plug neutral conductor blade and to be paired with a line conductor slot;

(c) a plurality of line conductor contacts associated with the plurality of line conductor slots;

(d) a plurality of neutral conductor contacts associated with the plurality of neutral conductor slots;

(e) means for interconnecting the plurality of line conductor contacts and isolating the plurality of line conductor contacts from the plurality of neutral conductor contacts;

(f) means for interconnecting the plurality of neutral conductor contacts and isolating the plurality of neutral conductor contacts from the plurality of line conductor contacts;

(g) means for connecting the line conductor wire to the line conductor contact interconnecting means; and (h) means for connecting the neutral conductor wire to the neutral conductor contact interconnecting means;

(i) in which the power capacity of the plurality of line conductor slots and the plurality of neutral conductor slots is substantially greater than the power capacity of the duplex receptacle;

(j) in which the line conductor contact interconnecting means comprise a bus bar;

(k) in which the neutral conductor contact interconnecting means comprise a bus bar, and in which the neutral bus bar leg portions adapted, upon positioning thereof in the receptacle, to tunnel under the line bus bar; and (l) in which the line and neutral bus bars are adapted to be inverted relative to each other and positioned in a supported position in the receptacle.

* * * * *